US010030924B1

(12) United States Patent
Smith

(10) Patent No.: US 10,030,924 B1
(45) Date of Patent: Jul. 24, 2018

(54) AUXILIARY BOLT CONTROL DEVICE

(71) Applicant: Clinton Lee Smith, Ozark, MO (US)

(72) Inventor: Clinton Lee Smith, Ozark, MO (US)

( * ) Notice: Subject to any disclaimer, the term of this patent is extended or adjusted under 35 U.S.C. 154(b) by 0 days.

(21) Appl. No.: 15/721,077

(22) Filed: Sep. 29, 2017

(51) Int. Cl.
*F41A 17/42* (2006.01)
*F41A 3/72* (2006.01)

(52) U.S. Cl.
CPC ..... *F41A 17/42* (2013.01); *F41A 3/72* (2013.01)

(58) Field of Classification Search
CPC ..... F41A 3/72; F41A 17/42
USPC ..... 89/138, 152, 153, 181, 188, 189, 190; 42/69.02, 14, 16
See application file for complete search history.

(56) References Cited

U.S. PATENT DOCUMENTS 9,291,412 B1 * 3/2016 Montes ..... F41A 17/36
D784,478 S * 4/2017 Therrell ..... F41A 17/42 D22/108
9,651,328 B1 * 5/2017 Oglesby ..... F41A 17/42
9,777,977 B1 * 10/2017 Makaron ..... F41A 11/00
2003/0208940 A1 * 11/2003 Johnson ..... F41A 3/12 42/18
2010/0251591 A1 * 10/2010 Burt ..... F41A 17/42 42/70.01
2011/0283580 A1 * 11/2011 Esch ..... F41A 17/42 42/14
2014/0150639 A1 * 6/2014 Sugg ..... F41A 3/68 89/193
2017/0160032 A1 * 6/2017 Overstreet ..... F41A 17/36
2017/0234638 A1 * 8/2017 Noonan ..... F41A 17/36 89/138
2017/0241729 A1 * 8/2017 Gangl ..... F41A 17/36
2017/0284761 A1 * 10/2017 Lewis ..... F41A 35/06
2017/0299303 A1 * 10/2017 Phipps ..... F41A 3/66

* cited by examiner

*Primary Examiner* — Bret Hayes
(74) *Attorney, Agent, or Firm* — Lathrop Gage L.L.P.

(57) ABSTRACT

The auxiliary bolt control device is for use with an automatic or semi-automatic firearm that utilizes a moveable bolt to feed ammunition from a magazine into the firearm. The auxiliary bolt control device allows the user of a firearm to actuate the firearm's bolt release lever with the user's hands in the firing position. This provides for greater speed and efficiency when loading a new magazine into the firearm.

7 Claims, 7 Drawing Sheets

100
120
124
116
138
119
136
134
130
126
131
112
110
106
108

114
222
132
5

AUXILIARY BOLT CONTROL DEVICE

BACKGROUND

Field of the Invention

The auxiliary bolt control device described herein relates to accessories for firearms, and more specifically to accessories for actuating the bolt release lever of a firearm.

SUMMARY OF THE INVENTION

The auxiliary bolt control device is designed for use with a firearm having a receiver with a grip for the user. The firearm has a bolt release lever attached to the receiver away from the grip. The bolt release lever pivots around a pin and may be difficult for a user to reach without removing a hand from the firing position. The auxiliary bolt control device allows the user of the firearm to operate the bolt release lever without removing a hand from the firing position.

The auxiliary bolt control device has the following components: a side plate with one or more mounting holes to attach it to the receiver using pins provided with the firearm; an extended bolt release lever attached to the side plate, which can pivot around its long axis; a linkage between the extended bolt release lever and the bolt release lever on the firearm; and an actuator on the extended bolt release lever adjacent to the grip so that a user can press the actuator without removing a hand from the grip.

When the user pushes the actuator the extended bolt release lever pivots around the pivot axis and the linkage causes the bolt release lever pivots around the pivot axis.

In one embodiment of the auxiliary bolt control device, the linkage between the extended bolt release lever and the bolt release lever is a paddle arm extending from the extended bolt release lever, and a two paddles attached to the outward end of the paddle arm and disposed on opposing sides of the bolt release actuator.

In another embodiment of the auxiliary bolt control device, the linkage between the extended bolt release lever and the bolt release lever is a pin extending from the extended bolt release lever along its pivot axis, wherein the pin is inserted into the cross pin hole of the bolt release lever.

The auxiliary bolt control device is also provided with an actuator arm that extends from the end of the extended bolt release lever near to the grip and an actuator attached to the outward end of the arm which a user can press to actuate the bolt release lever using the extended bolt release lever.

DETAILED DESCRIPTION

The auxiliary bolt control, as disclosed in reference to the embodiments depicted in the figures, provides an improved means of actuating the bolt control lever provided with a firearm. This auxiliary bolt control is specifically designed for use with firearms that utilize magazines to feed ammunition into the firearm, and a sliding bolt that is forced in a rearward direction after each round is fired. During the normal operation of such a firearm, the movement of the bolt in the rearward direction ejects the cartridge left by the just-fired round of ammunication. As the bolt automatically moves in a forward direction due to a spring or other similar mechanism in the firearm, the bolt feeds the next round of ammunition from the magazine into the firearm.

Many firearms that utilize magazines for feeding rounds of ammunition into the firearm are designed to lock the bolt in a rearward position when the final round of ammunition in the magazine has been fed into the firearm and fired by the operator. Locking the bolt in the rearward position allows the operator of the firearm to remove the empty magazine and insert another magazine containing rounds of ammunition into the firearm. The user then actuates a bolt release lever or similar mechanism on the firearm to cause the bolt to slide forward, loading the first round of ammunition from the new magazine into the firearm.

Figure 1:
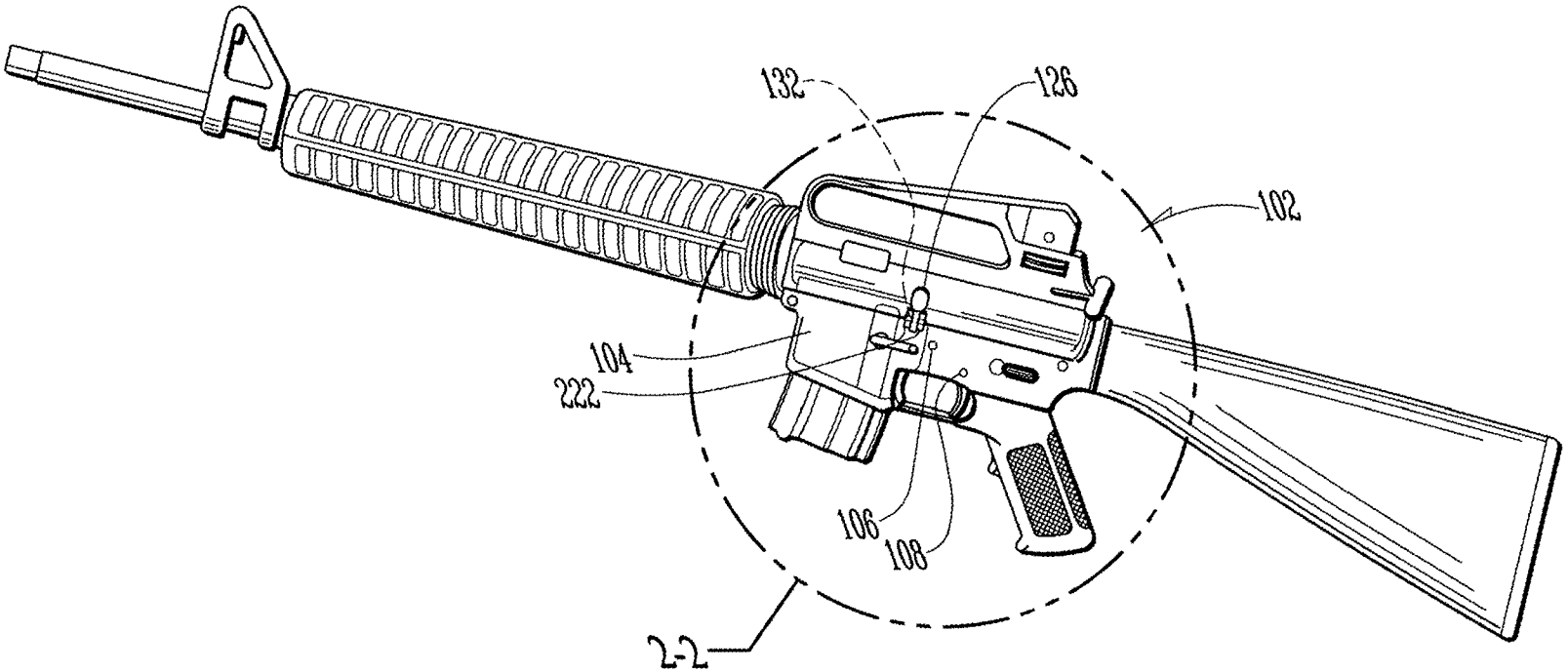
FIG. 1 is a perspective view of a firearm with which embodiments of the auxiliary bolt control may be utilized.

Referring to FIG. 1, a perspective view of a firearm 102 with which the auxiliary bolt control may be used is depicted. The firearm 102 has a receiver 104 that receives the magazine and contains the trigger, the bolt, and related mechanisms. In the depicted firearm 102, a hammer pin 106 and a trigger pin 108 are inserted into the receiver 104 to secure various internal components of the firearm 102. The firearm 102 is also provided with a a bolt release lever 126 to allow the user to cause the bolt to slide forward as described above. In the depicted firearm, bolt release lever 126 is pivotally mounted to the firearm 102 by a cross pin 132 that extends through mounting blocks 222. The cross pin 132 is coincident with a pivot axis around which the bolt release lever 126 pivots when actuated by a user.

In many firearms, the bolt release lever 126 pivots during operation of the firearm as the result of user actuation or of mechanical actuation such as by the "follower" in the magazine. For example, in an AR-15 rifle, when the last round of ammunication is fired from the firearm 102, the bolt release lever 126 is pivoted away from the firearm 126 by a "follower" or similar device in the magazine into an outward position. When in the outward position, the bolt release lever 126 will not allow the bolt to return to its forward position. When a user desires to cause the bolt to return to the forward position, the user presses the bolt release lever actuator 134 towards the firearm into an inward position, thus releasing the bolt and allowing it to slide forward. The bolt release lever 126 pivots around the cross pin 132 that secures it to the firearm 102 while permitting rotational motion of the bolt release lever 126.

The location of the bolt release lever 126 varies in different firearm designs, and can greatly impact the speed and efficiency with which the process of reloading a firearm with an empty magazine may be accomplished in actual usage. In some firearms, such as the one depicted in FIGS. 1, 2, and 6, the bolt release lever 126 is located on the left side of the firearm 102. As a user holds the firearm 102 to fire ammunition, neither of the user's hands are within reach of the bolt release lever actuator 132, thus requiring the user to remove one hand from a firing position to actuate the bolt release lever 126 by pressing on actuatory 132. This adds an additional step to the process of reloading a firearm, and may require the user to lower the firearm and look away from the target, which are both actions that may be undesirable in certain situations.

Figure 2:
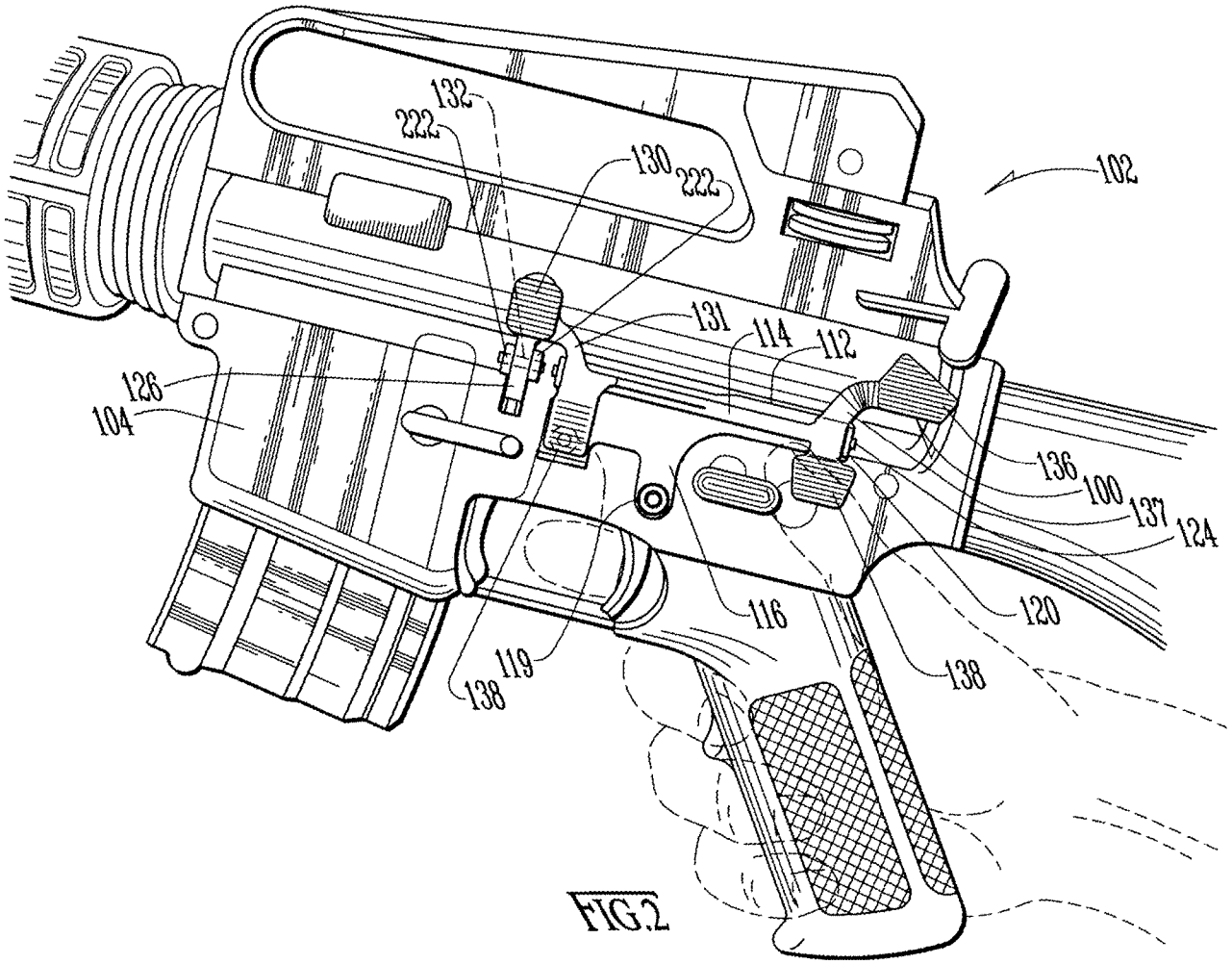
FIG. 2 is a detail perspective view of a portion of a firearm with a first embodiment of the auxiliary bolt control device attached thereto.
Figure 6:
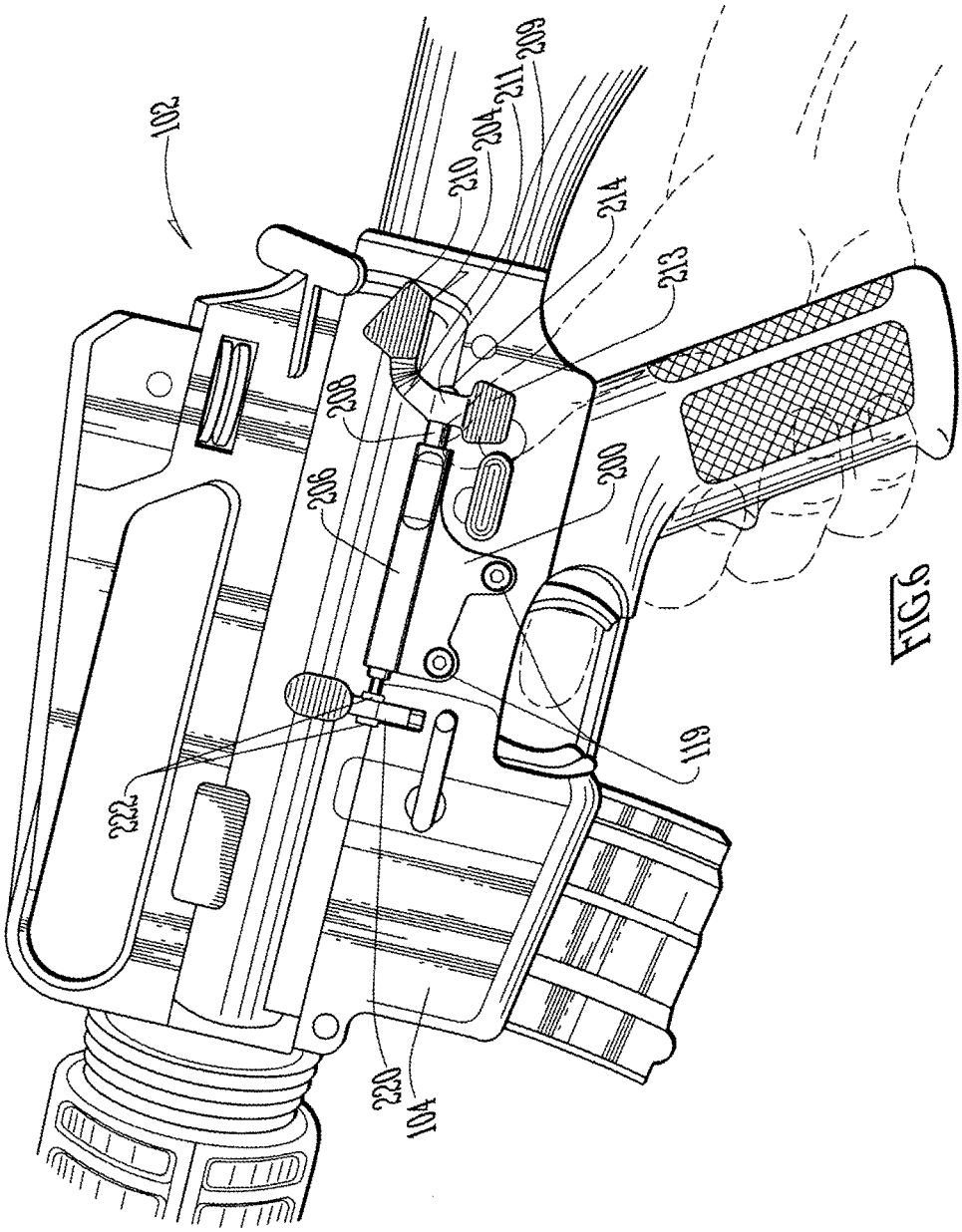
FIG. 6 is a perspective detail view of a portion of a firearm with a second embodiment of the auxiliary bolt control device attached thereto.

Referring to FIGS. 2 and 6, a user's hand is shown in dashed lines holding a grip portion of the receiver 104, and the actuator portion of bolt release levers 126 and 220, respectively, is disposed apart from any of the user's fingers. In this context, being "disposed apart from the grip" means that none of the user's fingers can actuate the bolt release levers 126 and 220 without the user's hand leaving the firing position on the grip shown in FIGS. 2 and 6. Similarly, it can be seen in FIGS. 2 and 6 that the actuators 136 and 210 of the extended bolt release lever are within reach of at least one of the user's fingers without removing the user's hand from the firing position on the grip. In this context, being "adjacent to the grip" means being within reach of at least one of the user's fingers while the user's hand is in the firing position on the grip shown in FIGS. 2 and 6.

An auxiliary device for actuating the bolt release 126 using a finger of one of the hands while in the firing position provides the greatest speed and efficiency of reloading such a firearm 102 with a new magazine. The auxiliary bolt control device, in the embodiments described herein and other embodiments, provides the ability to actuate the bolt release lever 126 using a finger of the operator's hands in the shooting position. The device described herein also does not require any modifications to the firearm, but simply attaches to the firearm as an accessory.

Figure 3:
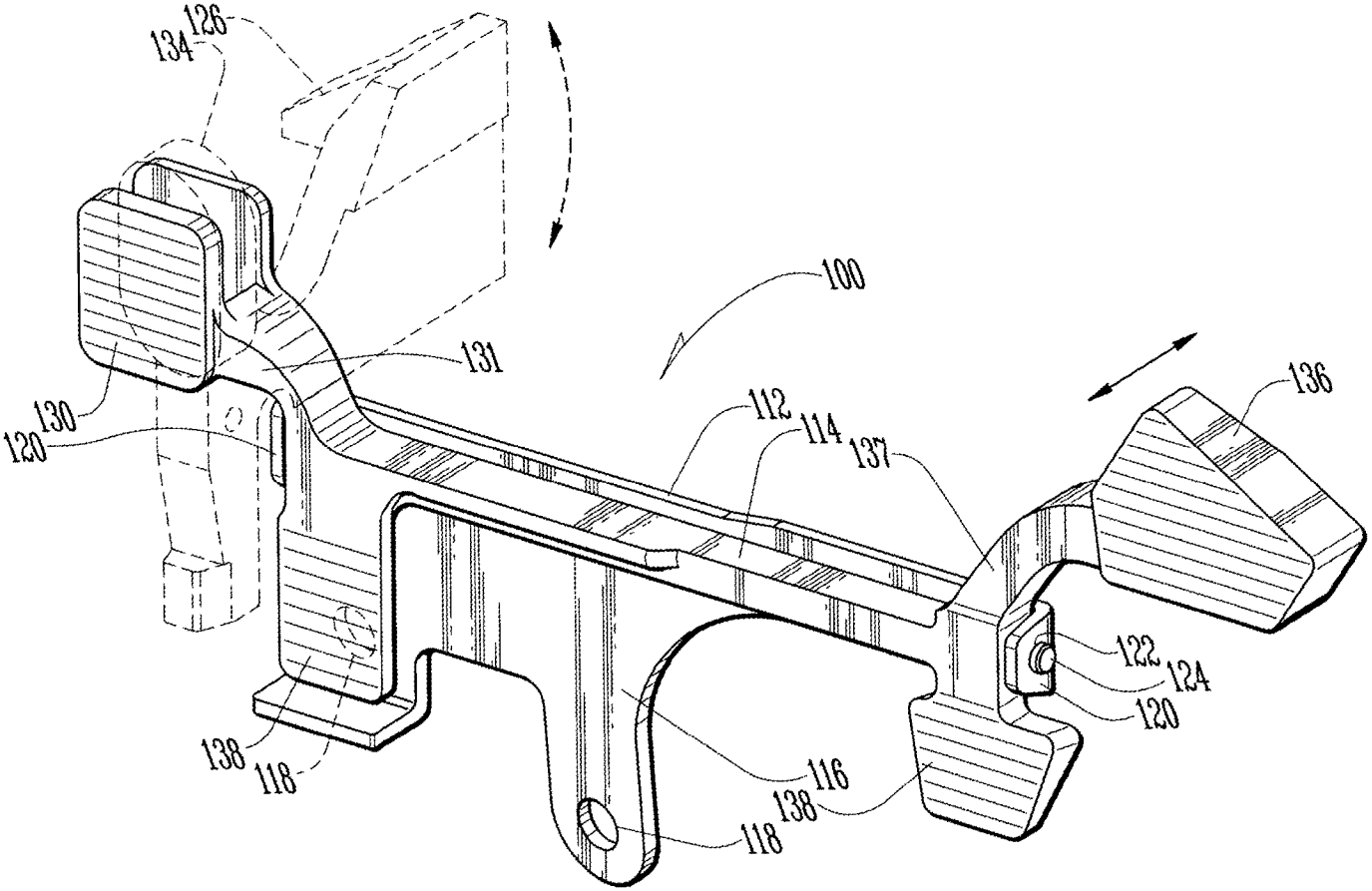
FIG. 3 is a perspective view of a first embodiment of the auxiliary bolt control device.
Figures 4, 5:
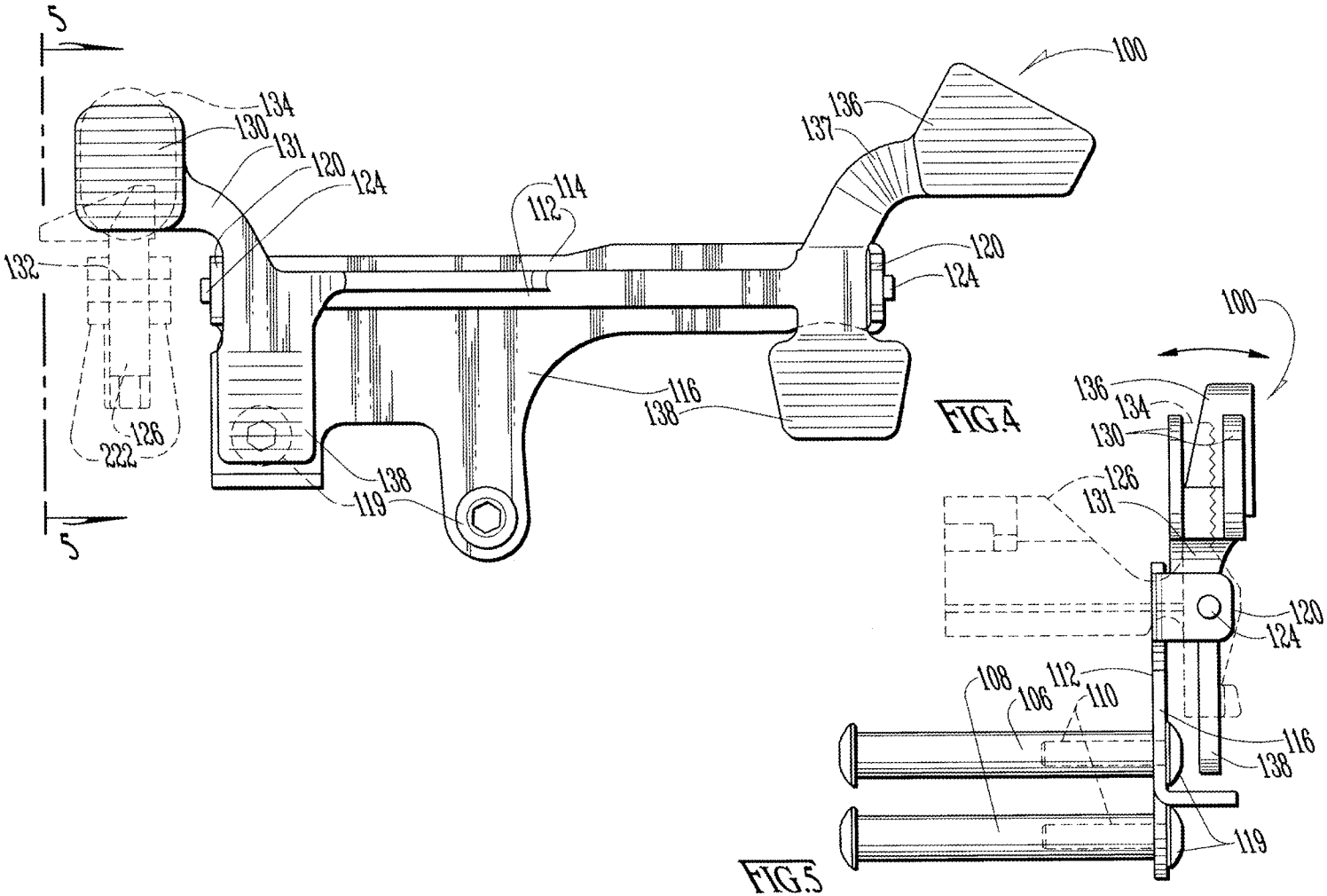
FIG. 4 is a side plan view of a first embodiment of the auxiliary bolt control device with the hammer pin and trigger pin attached thereto.
FIG. 5 is an end plan view of a first embodiment of the auxiliary bolt control device with the hammer pin and trigger pin attached thereto.

Referring now to FIGS. 2-5, a first embodiment of the auxiliary bolt control device is depicted. FIG. 2 depicts a detail perspective view of the portion 2-2 of a firearm shown in FIG. 1 with a first embodiment of the auxiliary bolt control device installed onto the firearm. FIG. 3 depicts a perspective view of the first embodiment of the auxiliary bolt control device. FIG. 4 depicts a side plan view of the first embodiment of the auxiliary bolt control device. FIG. 5 depicts an end plan view of the first embodiment of the auxiliary bolt control device along the axis labeled 4-4 on FIG. 4.

The device 100 is mounted on the receiver 104 of the firearm 102. The receiver 104 utilizes pins to hold the various parts of the firearm in place. In the depicted embodiment, a hammer pin 106 and a trigger pin 108 are provided for securing the internal components of the firearm. The auxiliary control device 100 is attached to the firearm using these pins 106 and 108. In other firearms, different pins or locations of the same pins may exist and be utilized to secure the device 100 to the firearm 102. In some embodiments of the device 100, replacement pins 106 and 108 may be provided as necessary to permit for the attachment of the device 102 to the pins 106 and 108. In the depicted embodiments, the pins 106 and 108 each have a female threaded screw receptacle 110 on the end of the pins to which the device 100 will be attached. In some embodiments the other end of the pins may also be provided with female threaded screw receptacles. Screws 119 or other means of attachment may be attached to the end of the pins 106 and 108 to hold them in place in the firearm 102.

The depicted embodiment of the device 100 comprises a side plate 112 and an extended bolt release lever 114. The side plate 112 is provided with a mounting surface 116 for attaching to the receiver 104. In the depicted embodiment, the mounting surface 116 is provided with two mounting holes 118 that are located to align with the ends of the pins 106 and 108. Screws 119 are secured through the mounting holes 118 into the female threaded receptacles 110 in pins 106 and 108 to hold the mounting surface securely against the side of the receiver 104. In other embodiments of the device 100, other configurations of pins or screws, or other means of attachment to the receiver 104, may be utilized to attach the device 100 to the firearm 102.

The depicted first embodiment, the side plate 112 further comprises first and second pivot tabs 120 for pivotally mounting the extended bolt release lever 114 to the side plate 112. In the depicted embodiment, the pivot tabs 120 are extensions of side plate 112 that are bent to extend perpendicularly from mounting surface 116. Each pivot tab 120 is provided with a pivot hole 122 for receiving a pivot pin 124 extending from the lever 114. The pivot holes are positioned on the pivot tabs such that when the device is installed on the firearm the pivot holes will align with the pivot axis. The first pivot tab is disposed at a first end of the side plate, and the second pivot tab is disposed at the second opposed end of the side plate, so that the extended bolt release lever may be held between them. In other embodiments, the tabs 120 may be formed of separate components that are attached to the side plate 112 using any known means of attachment such as welding.

Extended bolt release lever 114 is pivotally attached to side plate 112. In the embodiment depicted in the figures, first and second pivot pins 124 are provided at the first and second ends of the extended bolt release lever, along the pivot axis, which is the desired axis of rotation of lever 114. The desired axis of rotation is substantially aligned with the axis of rotation, also referred to as the pivot axis, of bolt release lever 126, which is preferably along the axis of bolt release lever cross pin 132, so that lever 114 rotates or pivots in the same manner as bolt release lever 126. The pivot pins 124 are inserted into holes 122 in tabs 120 on side plate 112. The tabs 120 and pins 124 hold the lever 114 in the desired position but do not restrict the lever from pivoting along the axis of the two pins 124. In some embodiments, the two pins 124 may be replaced with a single pin 124 that extends through the length of lever 114.

The lever 114 is provided with an linkage 128 for engaging the bolt release lever 126 that is part of the firearm 104. In the depicted embodiment, the linkage is attached to a first end of extended bolt release lever 114. The bolt release lever 126 is pivotally secured to the firearm 102 by a cross pin 132. The lever 126 pivots around cross pin 132 when the firearm operator pushes on actuator end 134 of lever 126. The pivot axis of the extended bolt release lever 114 is aligned with the axis of the cross pin 132 so that as linkage 128 rotates around the pivot axis of lever 114 it causes lever 126 to pivot around the axis of cross pin 132.

In the first depicted embodiment, the linkage 128 comprises paddles 130 disposed on either side of the lever 126. Paddles 130 extend from one end of the lever 114 and are offset from the pivot axis of lever 114 by paddle arm 131 so that as the lever 114 is pivoted around the pivot axis, the paddles 130 move in an arc around that axis. The pivot arm 131 extends from the extended bolt release lever in a direction that is away from the pivot axis, at least partially, so that the outward end of the paddle arm 131 where the paddles 130 are attached moves in an arc around the axis. The paddles 130 are attached to the outward end of paddle arm 131.

Since the paddles 130 are disposed on opposite sides of the lever 126, as paddles 130 move in an arc, the actuator end 134 of lever 126 also moves pivotally around the axis of the cross pin 132, causing the actuation of the bolt release lever 126. Similarly, when the actuator end 134 of lever 126 moves pivotally due to the operation of the firearm, it causes the paddles 130 to move in an arc and rotates lever 114.

Actuator 136 extends from the opposite end of the lever 114 as linkage 128. In the depicted embodiment, the actuator 136 extends from a second end of the lever 114. Actuator 136 is offset from the pivot axis of lever 114 by an actuator arm 137 to allow a user to cause the rotation of lever 114 by pushing on actuator 136. The actuator arm extends from the end of the extended bolt release lever that is nearest to the grip of the firearm. The actuator arm 137 extends outwardly from the extended bolt release lever away from the pivot axis of the extended bolt release lever. The actuator arm 137 provides leverage to a user so that it is easier to pivot the extended bolt release lever with one finger or thumb.

The actuator 136 is approximately aligned with the actuator end 134 of the bolt release lever 126, so that when the "follower" or other mechanical device pivots the bolt release lever 126 into the outward position the extended bolt release lever 114 will also pivot and actuator 136 also pivots into an outward position. When actuator 136 is in the outward position, the user may push it inwardly toward the firearm with a thumb or other finger, thus causing the extended bolt release lever 114 to rotate causing paddles 130 to pivot inwardly toward the firearm, and forcing the actuator end 136 of the bolt release lever to pivot to the inward position and release the bolt to slide into the forward position.

In some embodiments, additional lower actuators 138 may be provided on the opposite side of the pivot axis of lever 114 from paddles 130. These actuators 138 may be pressed by the user of the firearm to rotate lever 114 in the opposite direction from actuator 136. When the user presses a lower actuator 138 toward the firearm, the paddles 130 will rotate away from firearm 102 and cause bolt release lever 126 to pivot to the outward position, which in turn will cause the bolt to be retained in the rearward position when the next round of ammunition is fired and the bolt cycles backward from the recoil.

Figure 7:
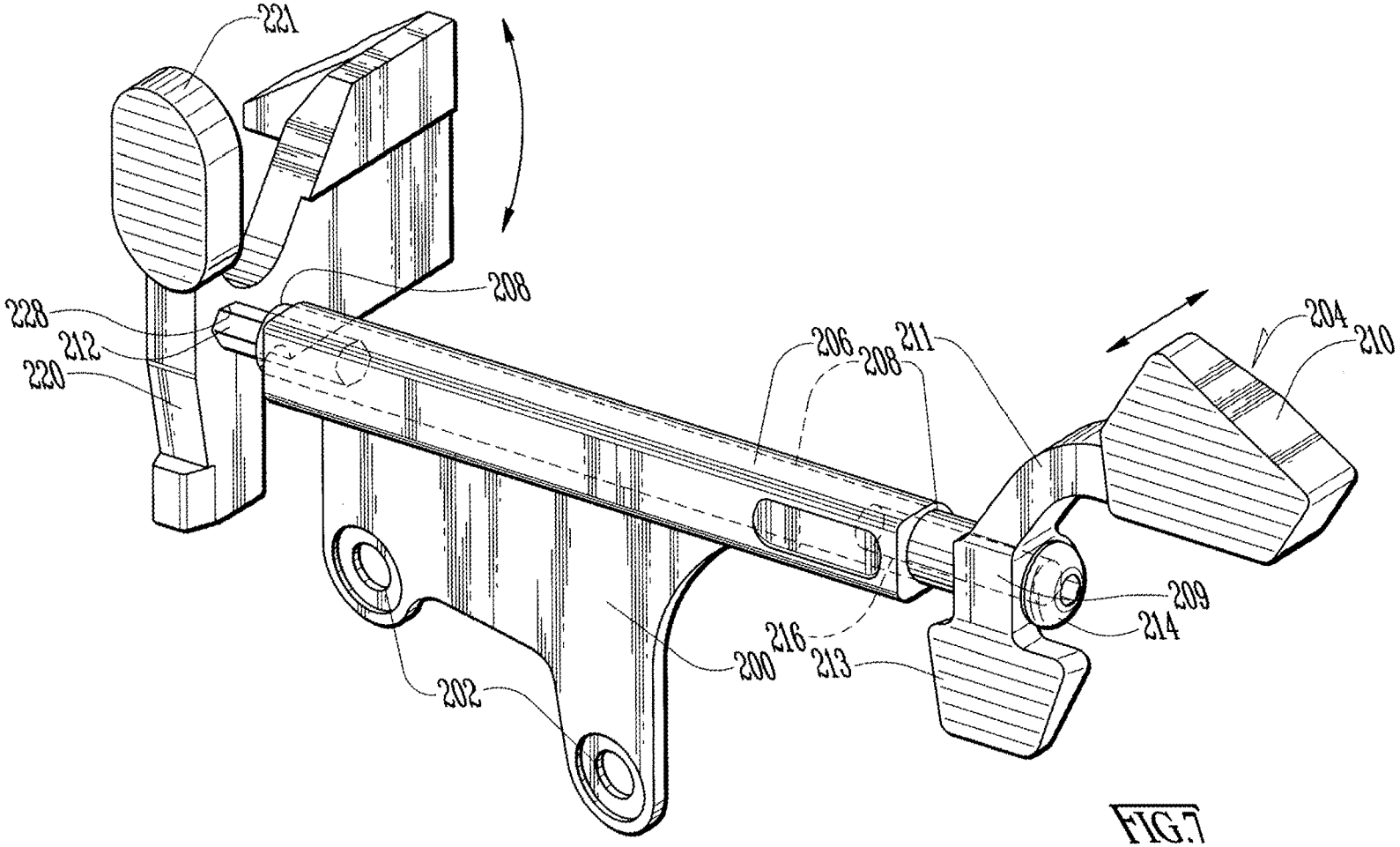
FIG. 7 is a perspective view of a second embodiment of the auxiliary bolt control device.
Figures 8, 9:
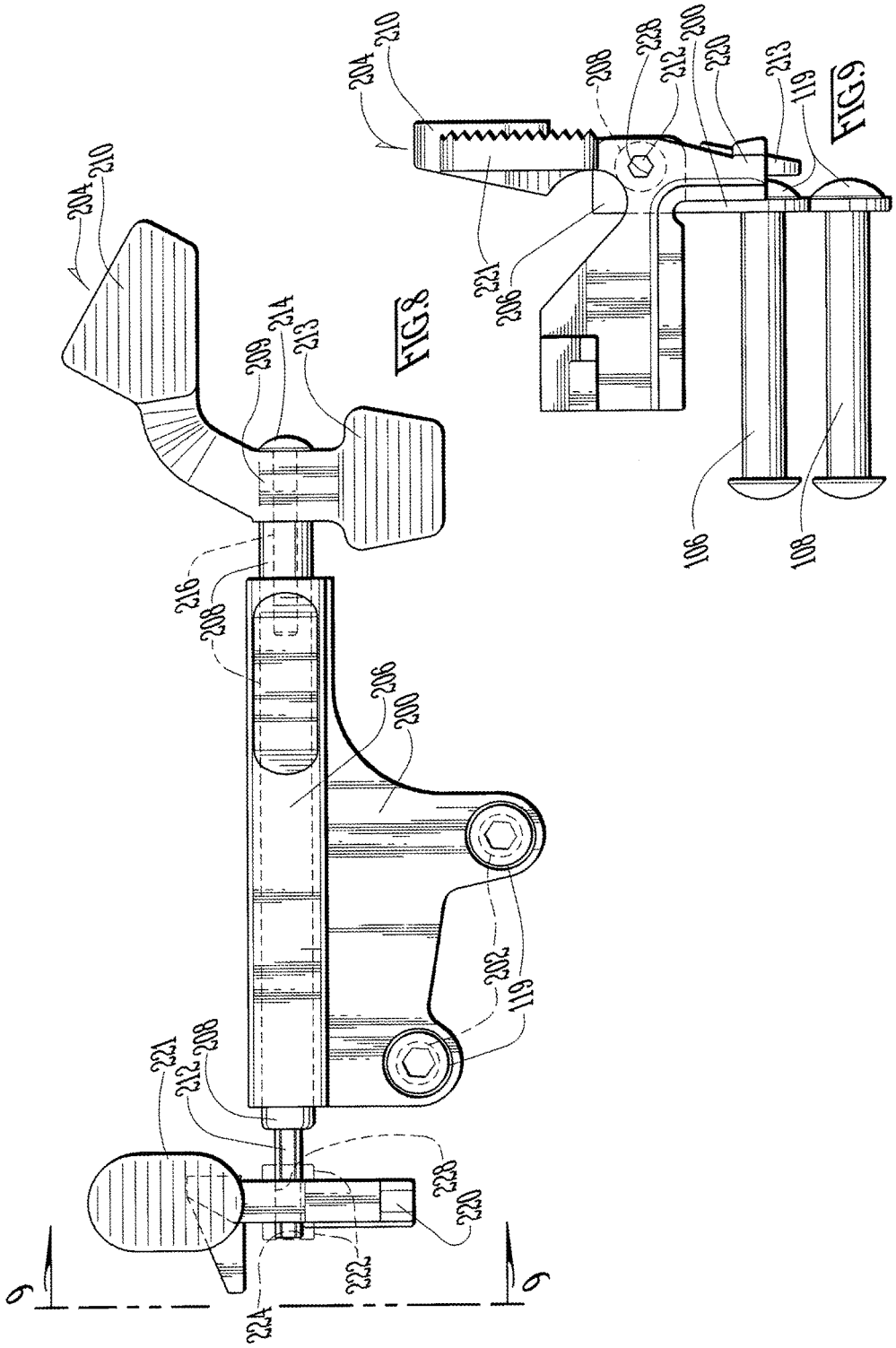
FIG. 8 is a side plan view of a second embodiment of the auxiliary bolt control device with the hammer pin and trigger pin attached thereto.
FIG. 9 is an end plan view of a second embodiment of the auxiliary bolt control device with the hammer pin and trigger pin attached thereto.

Referring now to FIGS. 6-9, a second embodiment of the auxiliary bolt control device is depicted. FIG. 6 depicts a detail perspective view of the portion 2-2 of a firearm shown in FIG. 1 with a second embodiment of the auxiliary bolt control device installed onto the firearm. FIG. 7 depicts a perspective view of the second embodiment of the auxiliary bolt control device. FIG. 8 depicts a side plan view of the second embodiment of the auxiliary bolt control device. FIG. 9 depicts an end plan view of the second embodiment of the auxiliary bolt control device along the axis labeled 8-8 on FIG. 8.

In the depicted second embodiment, the side plate 200 is provided with mounting holes 202 for attaching the side plate 200 to the firearm 102 using pins such as hammer pin 106 and trigger pin 108. In this depicted embodiment, the extended bolt release lever 204 is attached to the side plate 200 via sleeve 206 that is formed integrally with side plate 200. The depicted embodiment of the sleeve 206 extends along the length of side plate 200 adjacent to the top edge thereof. In other embodiments, the sleeve 200 may comprise two or more sleeves that are disposed on side plate 200, or sleeve 200 may extend along less than the entire length of side plate 200. In some embodiments, sleeve 206 may be formed separately from side plate 200 and attached to side plate 200 by welding, screws, or some other suitable method of attachment. The sleeve 206 is provided with a cylindrical bore substantially aligned with the pivot axis. The bore receives cylindrical pin 208, described below, and holds it in alignment with the pivot axis will allowing it to rotate around the pivot axis.

The depicted second embodiment of the extended bolt release lever 204 comprises a cylindrical pin 208, actuator mount 209, actuator 210, and pin 212. Actuator mount 209 is fixedly attached to a first end of cylindrical pin 208. In the depicted embodiment, a screw 214 is inserted through a hole in actuator mount 209 and secured in a threaded screw receptacle 216 provided in the first end of cylindrical pin 208. In other embodiments, the actuator mount 209 may be formed integrally with pin 208, welded to pin 208, or otherwise attached to pin 208. Actuator 210 is attached to actuator mount 209 and offset from the pivot axis of pin 208 by an actuator arm 211 to allow a user to cause the rotation of lever 204 by pushing on actuator 210.

In some embodiments, additional lower actuator 213 may be provided on the opposite side of the pivot axis of lever 204 from actuator 210. The pivot axis of lever 204 is the axis of rotation of cylindrical pin 208. The lower actuator 213 may be pressed by the user of the firearm to rotate lever 204 in the opposite direction from actuator 210. When the user presses a lower actuator 213 toward the firearm, the pin 212 will be rotated and cause bolt release lever 220 to pivot to the outward position, which in turn will cause the bolt to be retained in the rearward position when the next round of ammunition is fired and the bolt cycles backward from the recoil.

In the second embodiment, the linkage between the extended lever 204 and the bolt release lever 220 consists of a pin 212 extending from the end of cylindrical pin 208. Pin 212 is fixedly attached to a second end of cylindrical pin 208 so that the longitudinal axis of pins 208 and 212 coincide and as one pin is rotated around that axis, the other pin will also rotate around the same axis. In the depicted embodiment, a first end of pin 212 is received by receptacle, or cross pin hole, 218 in the second end of cylindrical pin 208. The pivot axis of the pins 208 and 212 is also coincident with the pivot axis of the bolt release lever 220 around the cross pin hole. In the depicted embodiment, pin 212 has a hexagonal cross-section to fixedly engage a cross pin hole with a hexagonal cross-section.

Firearm 102 is provided with a standard bolt release lever 220 which is pivotally mounted to the firearm 102. In some embodiments, firearm 102 is provided with two mounting blocks 222 for pivotally mounting the bolt release lever 220 to the firearm 102. In the depicted embodiment, mounting blocks 222 are formed as an integral part of the receiver 104 of firearm 102. The mounting blocks 222 are disposed on opposite sides of the desired location of the bolt release lever 220. Each mounting block 222 is provided with a mounting hole 224 for receiving cross pin 226. Bolt release lever 220 is provided with a cross pin hole 228 for receiving cross pin 226. When installed in firearm 102, bolt release lever 220 is disposed between mounting blocks 222 with cross pin hole 228 aligned with mounting holes 224, and cross pin 226 inserted through holes 224 and 228. Bolt release lever 220 is not fixedly attached to cross pin 226 so that lever 220 pivots around the longitudinal axis of pin 226.

When the extended bolt release lever 204 is installed on the firearm, the cross pin 226 is removed and replaced by the pin 212. In the depicted embodiment the pin 212 has a hexagonal cross-section, while in other embodiments it may have a circular or polygonal cross-section. The pin 212 may extend from cylindrical pin 208, through holes 224 and 228 in mounting blocks 222 and bolt release lever 220. The pin 212 is free to rotate within the holes 224 in mounting blocks 222, but is secured to bolt release lever 220, so that if either pin 212 or lever 220 rotate then the other will also rotate in the same manner. In some embodiments, the pin 212 may be cylindrical or have detentes for receiving set screws or other means of securing the pin to the bolt release lever 220. In some embodiments of the invention, it may be necessary to modify the hole 28 in bolt release lever 228 so that it can receive and be secured to hexagonal pin 212 or other form of pin 202.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. An auxiliary bolt control device for a firearm having a receiver, the receiver having a grip for a user to hold the firearm during operation, and a bolt release lever pivotally attached to the receiver and disposed apart from the grip, said bolt release lever pivoting around a pivot axis, the auxiliary bolt control device comprising:

a side plate having at least one mounting hole for releasably attaching the side plate to the receiver;

an extended bolt release lever pivotally attached to the side plate;

a linkage attached to and extending from a first end of the extended bolt release lever for engaging the bolt release lever;

an actuator attached to and extending from a second end of the extended bolt release lever adjacent to the grip;

wherein said extended bolt release lever pivots around the pivot axis; and wherein the linkage connects the extended bolt release lever to the bolt release lever such that when the extended bolt release lever pivots around the pivot axis the bolt release lever pivots around the pivot axis.

2. The auxiliary bolt control device of claim 1, the bolt release lever further comprising a bolt release actuator disposed away from the pivot axis, the auxiliary bolt control device having a linkage that comprises:

a paddle arm extending from the first end of the extended bolt release lever away from the pivot axis to an outward end of the paddle arm; and a first paddle and a second paddle attached to the outward end of the paddle arm;

wherein the first paddle and the second paddle are disposed on opposing sides of the bolt release actuator.

3. The auxiliary bolt control device of claim 2 wherein an actuator arm is attached to and extends from the second end of the extended bolt release lever away from the pivot axis to an outward end of the actuator arm, and the actuator is attached to the outward end of the actuator arm.

4. The auxiliary bolt control device of claim 3 wherein the extended bolt release lever further comprises a first pivot pin extending from the first end of the extended bolt release lever along the pivot axis, and a second pivot pin extending from the second end of the extended bolt release lever along the pivot axis;

wherein the side plate further comprises a mounting plate, and a first and a second pivot tab extending perpendicularly to the mounting plate and disposed at a first and a second end of the mounting plate, respectively, each pivot tab having a pivot hole disposed in the pivot axis for receiving the first and second pivot pins.

5. The auxiliary bolt control device of claim 1, the bolt release lever further comprising a cross pin hole disposed on the pivot axis of the bolt release lever, the auxiliary bolt control device having a linkage that comprises:

a pin extending from the first end of the extended bolt release lever along the pivot axis;

wherein the pin is inserted into the cross pin hole and fixedly attached to the bolt release lever.

6. The auxiliary bolt control device of claim 5 wherein an actuator arm is attached to and extends from the second end of the extended bolt release lever away from the pivot axis to an outward end of the actuator arm, and the actuator is attached to the outward end of the actuator arm.

7. The auxiliary bolt control device of claim 5 wherein the extended bolt release lever comprises a cylindrical pin; and wherein the side plate further comprises a mounting plate and a sleeve attached to the mounting plate, the sleeve having a cylindrical bore for receiving the cylindrical pin.

* * * * *